US005347919A

United States Patent [19]

Nordberg

[11] Patent Number: 5,347,919

[45] Date of Patent: Sep. 20, 1994

[54] TRACTIVE TIRE COMPACTOR

[76] Inventor: Henry T. Nordberg, 510 Lake Rd., Oneida, N.Y. 13421

[21] Appl. No.: 78,936

[22] Filed: Jun. 16, 1993

[51] Int. Cl.[5] ..... B65B 27/06; B30B 1/00

[52] U.S. Cl. ..... 100/12; 100/25; 100/230; 100/269 R; 100/295

[58] Field of Search ..... 100/12, 25, 214, 230, 100/269 R, 295

[56] References Cited

U.S. PATENT DOCUMENTS

| | | | |
|---|---|---|---|
| 216,392 | 6/1879 | Gardner | 100/230 |
| 2,920,555 | 1/1960 | Sherriff | 100/12 X |
| 3,100,438 | 8/1963 | Merker | 100/214 |
| 3,129,658 | 4/1964 | Valente | 100/12 X |
| 3,195,444 | 7/1965 | McLean | 100/7 |
| 3,211,085 | 10/1965 | Zeppetello | 100/214 |
| 3,212,429 | 10/1965 | Fay et al. | 100/7 |
| 3,241,551 | 3/1966 | Tambascia . | |
| 3,318,231 | 5/1967 | Felts | 100/214 X |
| 3,498,212 | 3/1970 | Boehm | 100/12 |
| 3,548,739 | 12/1970 | Glasson | 100/12 X |
| 3,675,569 | 7/1972 | Moor | 100/7 |
| 3,732,806 | 5/1973 | Bourgeois | 100/295 |
| 3,877,348 | 4/1975 | Sandlin | 92/13 |
| 3,955,491 | 5/1976 | McMahon | 100/7 |
| 4,024,805 | 5/1977 | Glasson | 100/12 |
| 4,121,512 | 10/1978 | Valdespino | 100/52 |
| 4,155,300 | 5/1979 | Baltschun | 100/269 R |
| 5,121,680 | 6/1992 | Nordberg | 100/12 |

FOREIGN PATENT DOCUMENTS

| | | | |
|---|---|---|---|
| 2150175 | 4/1973 | Fed. Rep. of Germany | 100/12 |
| 3040324 | 6/1982 | Fed. Rep. of Germany | 414/27 |
| 889238 | 2/1962 | United Kingdom | 100/214 |
| 940871 | 11/1963 | United Kingdom | 100/214 |
| 1091151 | 11/1967 | United Kingdom | 100/12 |

*Primary Examiner*—Stephen F. Gerrity
*Attorney, Agent, or Firm*—Harris Beach & Wilcox

[57] ABSTRACT

A machine for compacting a row of tires in side-by-side relationship comprises a support housing containing a dual action hydraulic cylinder. A first compactor plate, contacting a first tire of the row is mounted on the support housing. An extended piston rod carrying a suitably dimensioned sleeve forms a probe that passes out of the support housing, through the first compactor plate and extends through the uncompacted row of tires, defining an external segment of the probe which varies in length as the piston is extended and retracted. A second compactor plate, mountable on the probe, contacts the last tire of the row. Thus the row of tires is compacted between the first compactor plate and the second compactor plate when the probe is retracted and the external segment is shortened. The probe is fully retractable through the first compactor plate to easily release the compacted row of tires therefrom. The compactor plates each have a plurality of slots for receiving binding wires therethrough, and the probe includes wire guides so that a wire can be wrapped about the compacted row of tires.

9 Claims, 5 Drawing Sheets

TRACTIVE TIRE COMPACTOR

BACKGROUND OF THE INVENTION

1. Field of the Invention.

This invention relates to an apparatus and method for compacting tires into a bundle. More particularly, this invention relates to a machine and method for compacting a number of tires arranged in a row into a concentrated bundle for easy handling and disposition.

2. Description of the Prior Art.

In recent years the problem of recycling or otherwise disposing of the common automobile and truck tires has become an increasing problem in the United States and elsewhere in the world. With increased environmental restrictions it is generally no longer feasible to merely burn the tires, or dispose of them in landfills. Recycling possibilities are the subject of considerable research, and tires are increasingly being recycled or used for other purposes. In addition to chopping up tires to from raw material for other processes, tires can be bundled and used to form artificial reefs, breakwaters for marinas, and for a variety of structural applications. Because storage space for used tires is valuable, it is desirable to compress and compact the tires into concentrated bundles for storage until final disposition. As tires are intentionally made to be very tough and resilient for their primary purpose, they present a formidable problem when it is desired to compact and bundle them into a dense, easily handled form.

Various hydraulically actuated machines are known for compacting a number of tires into a bundle by a movable plate compressing a row of tires against a fixed plate. In order to be commercially successful, twenty to thirty tires must be compressed at a time, which has required machines approaching 30 feet in length, and having very long piston stroke lengths. Buckling of the assembled tires during compacting has been a matter of concern. Stability of the fully extended piston rod, lateral stress on the rod, and rapid cylinder wear have also been problems in the art. My U.S. Pat. No. 5,121,680 discloses a compacting machine having a relatively short footprint and increased stability. While this device works well, it requires a relatively complex mechanism for insuring stability of the extended piston rod, and improvements in cycle time have been desired. This device further demands the physical extraction of a fully compacted and bundled group of 20–30 tires from its probe. In practice this increases operational expense, as tire-handling machinery must be provided to handle the heavy tire masses.

SUMMARY OF THE INVENTION

It is therefore a primary object of the present invention to provide an improved tire compactor that can be safely operated over a long period of time with minimum damage and wear to the machine components.

It is a further object of the present invention to provide an improved tire compacting machine having a simplified and economical construction.

It is yet another object of the present invention to provide a tire compacting machine having a decreased cycle time and a large throughput that facilitates the removal of compacted tires therefrom.

These and other objects of the present invention are attained by a machine for compacting a row of tires in side-by-side relationship. A support housing that includes a frame contains an elongated hydraulic cylinder/piston combination which is connected to a butt plate at the end of the support housing.

A first compactor plate, contacting a first tire of the row is mounted on the support housing.

Hydraulics are provided for moving the cylinder/piston combination between an extended position and a retracted position. The extended cylinder/piston combination forms a probe that passes out of the support housing, through the first compactor plate and extends through the uncompacted row of tires, defining an external segment of the probe which varies in length as the cylinder/piston is extended and retracted.

A second compactor plate, mountable on the probe, contacts the last tire of the row. Thus the row of tires is compacted between the first compactor plate and the second compactor plate when the piston and the probe is retracted by the hydraulics as the external segment is shortened.

Both compactor plates are preferably reinforced by gussets.

In one aspect of the invention the probe is fully retractable through the first compactor plate to easily release the compacted row of tires therefrom. A rack may be provided to hold the tires in suitable alignment preparatory to compaction or to convey the compacted product away.

In another aspect of the invention the compactor plates each have a plurality of slots for receiving binding wires therethrough, and the probe includes wire guides so that a wire can be wrapped about the compacted row of tires. The slots are open to the periphery of the plates and are inwardly directed.

In yet another aspect of the invention mounting of the second compactor plate is realized by an end plate disposed at an end of the probe, the end plate being provided with an axial post and a plurality of end bolts that align with a central aperture and a plurality of keyholes in the second compactor plate. When the end plate is suitably rotated, the second compactor plate can be mounted or dismounted from the end plate.

In the known prior art devices, the greatest compacting pressure is developed while the piston rod is extended, the state in which lateral stability of the cylinder is at a minimum. In the preferred embodiment of the invention increased compacting pressure is associated with retraction of the piston rod, and shortening of the probe that passes through the tires undergoing compaction. This results in a simpler, and far more mechanically stable arrangement. Resort to complicated stabilizing arrangements such as cylinder support followers is unnecessary, and cylinder wear is substantially reduced.

BRIEF DESCRIPTION OF THE DRAWINGS

For a better understanding of these and other objects of the present invention, reference is made to the detailed description of the invention which is to be read in conjunction with the following drawings, wherein.

DESCRIPTION OF THE PREFERRED EMBODIMENT

Figure 1:
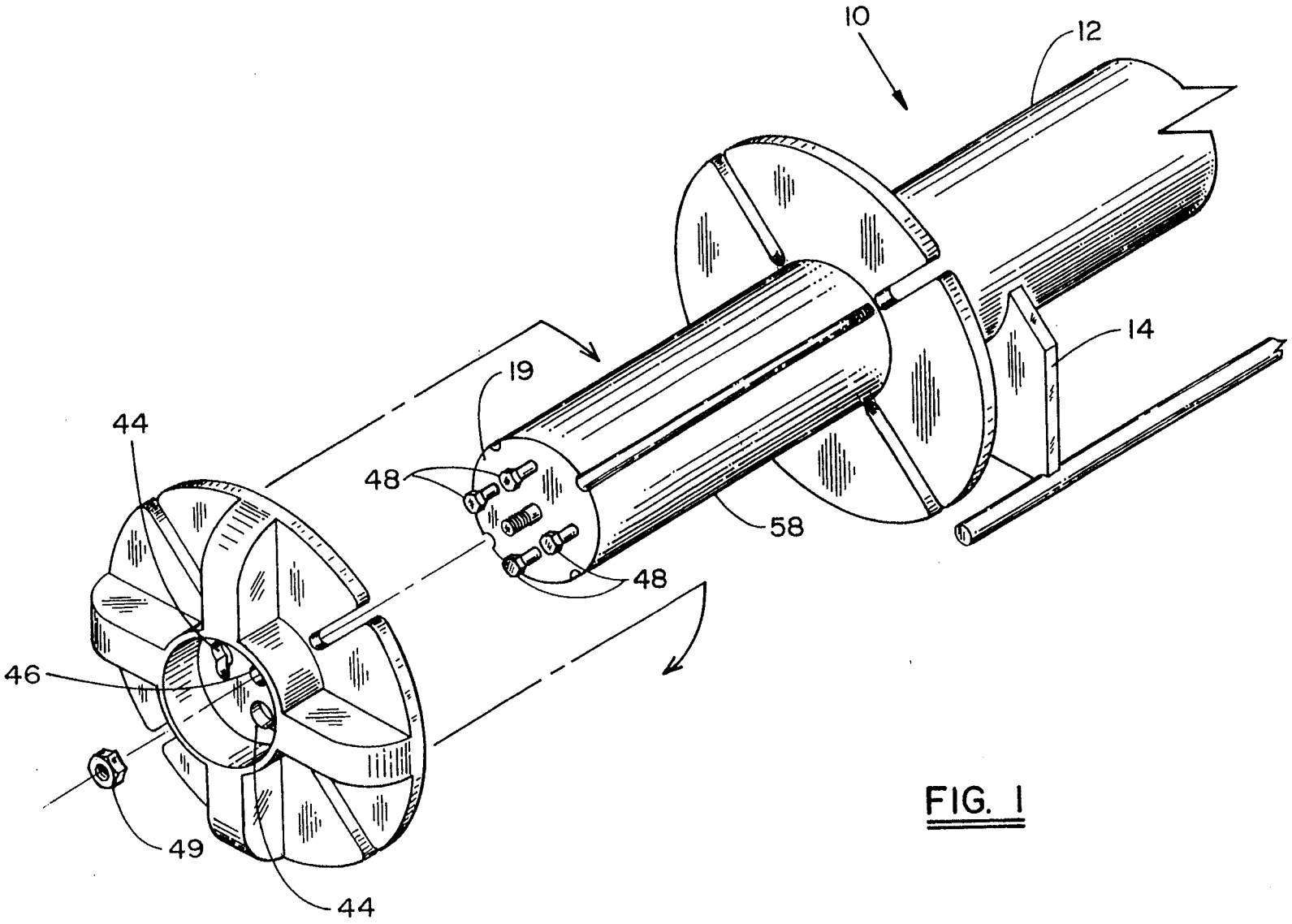
FIG. 1 is a partial perspective view of a preferred embodiment in accordance with the invention.
Figure 2:
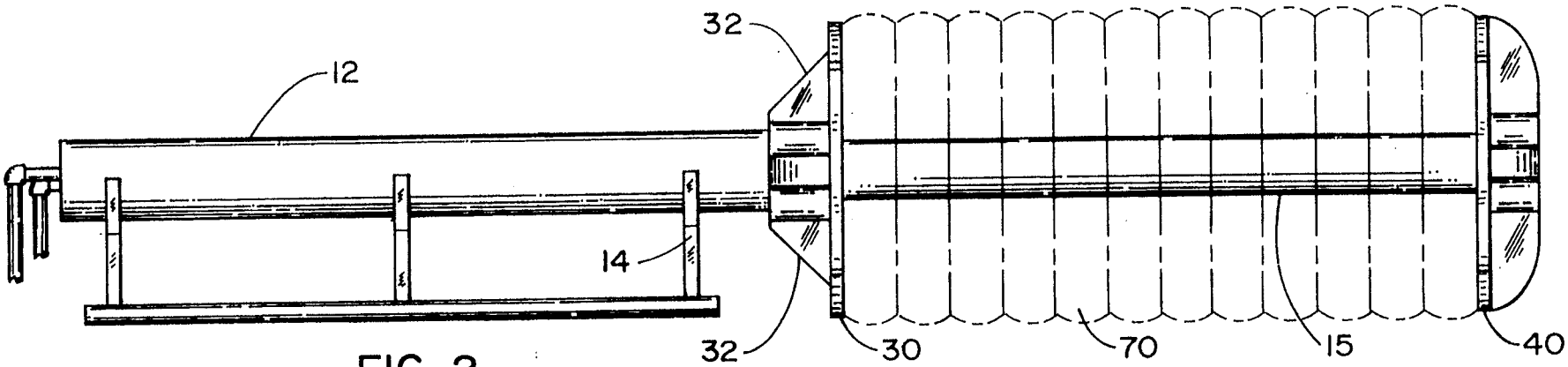
FIGS. 2 and 3 are side elevations of the embodiment of FIG. 1, with an uncompacted and a compacted row of tires shown respectively thereon in phantom.
Figure 3:
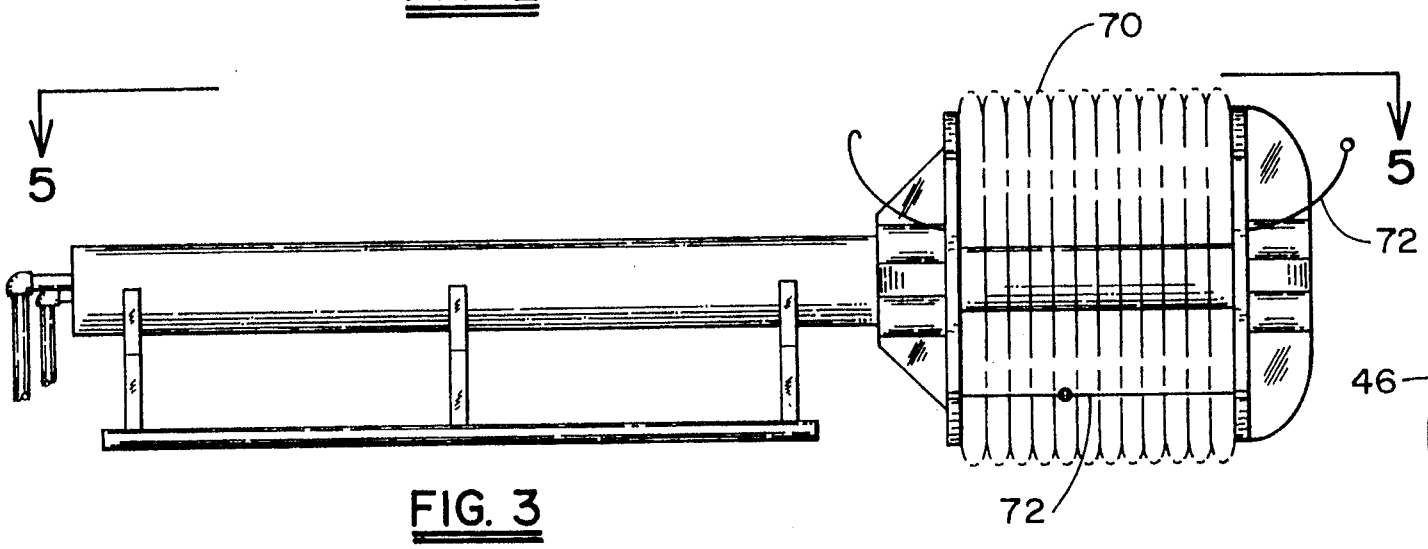

Turning now to the drawings, in FIGS. 1–5 there is illustrated a preferred embodiment of a tire compacting machine 10 in accordance with the invention. A cylindrical support housing 12 is supported on an elongated frame 14. A dual action cylinder/piston combination 20, comprising piston 25, piston rod 13, and cylinder 27 is disposed in the support housing 12, connected to a butt plate 16, and having a stroke length suitably dimensioned to accommodate a bundle of tires to be compacted. The cylinder is provided with suitable seals 22, 24, and access ports 26, 28 that are connected to suitable hydraulics (not shown). While the frame 14 is illustrated as skeletal structure for clarity, it is possible to integrate the hydraulic machinery into the frame. Piston rod 13, attached to piston 25, extends through open end 17 of the support housing, and carries thereon an inner sleeve or tube 15 which, in accordance with the movement of piston rod 13, has an internal segment that fits slidably inside support housing 12 and an external segment that passes through the central apertures of the tires being compacted. An end plate 19 stabilizes piston rod 13 with respect to inner tube 15.

Figure 8:
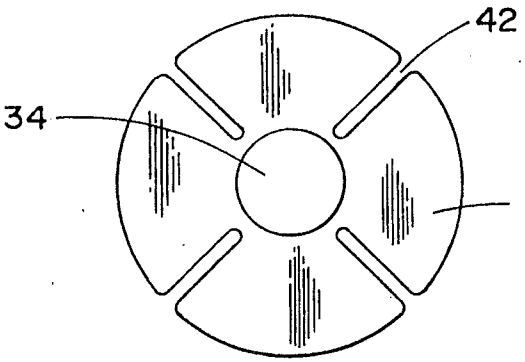
FIG. 8 is an end view of a fixed compression plate of the embodiment of FIG. 1.
Figure 6:
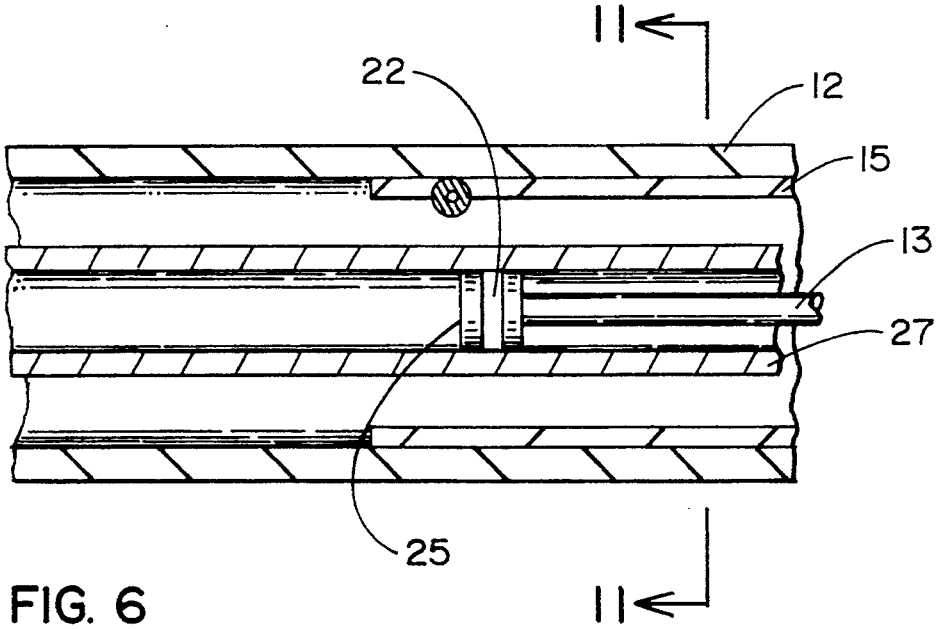
FIGS. 6 and 7 are detail views of portions of FIG. 5 on an enlarged scale.
Figure 7:
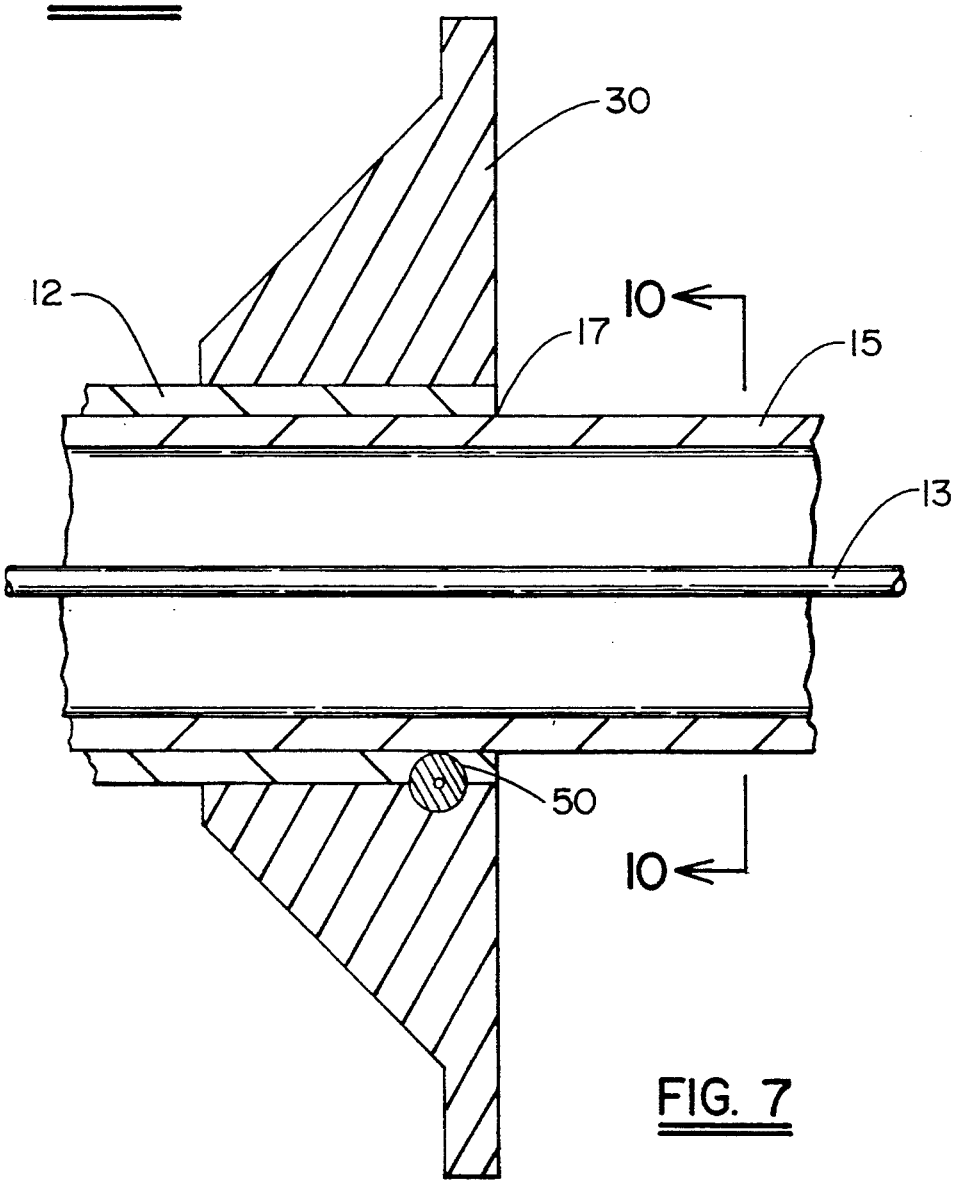

The open end 17 of support housing 12 is provided with a fixed circular compactor plate 30 which has a diameter approximately equal to the diameter of the tires to be compacted, and which is firmly mounted and reinforced a plurality of gussets 32, 32. A central aperture 34, as best seen in FIG. 8, is dimensioned to fit over the outer diameter of support housing 12. The inner tube 15 thus passes through aperture 34 as it exits through open end 17 of support housing 12.

Figure 9:
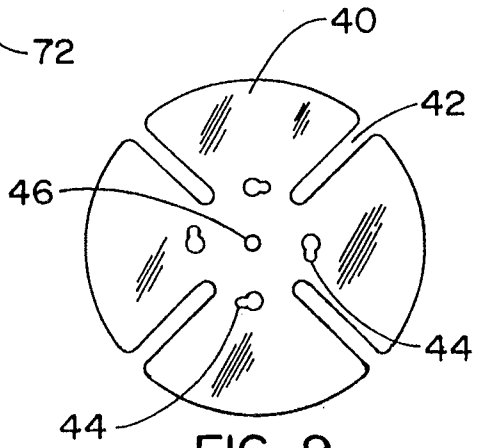
FIG. 9 is an end view of the detachable compression plate of the embodiment of FIG. 1.
Figure 5:
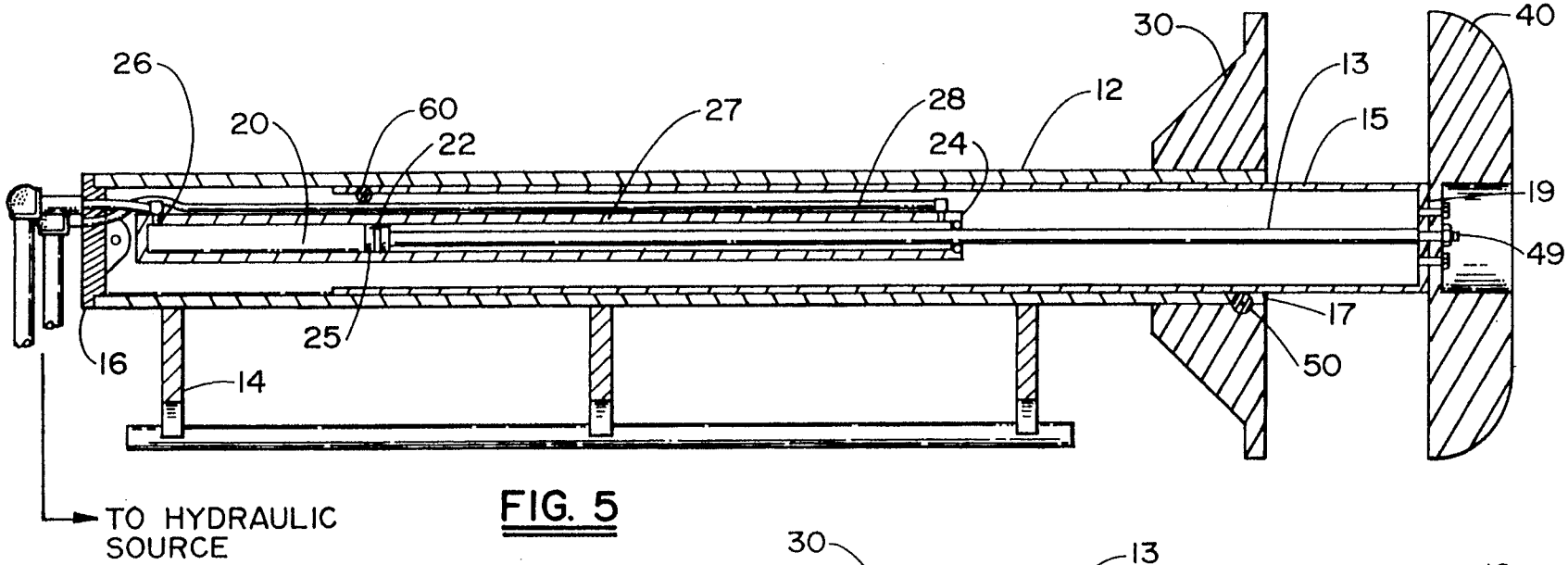
FIG. 5 is a sectional view through line 5—5 of FIG. 3 with the tires not shown.
Figure 11:
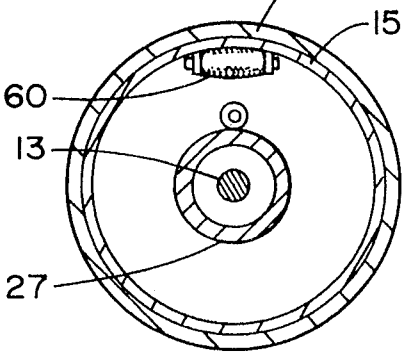
FIG. 11 is a sectional view taken through line 11—11 of FIG. 6.
Figure 10:
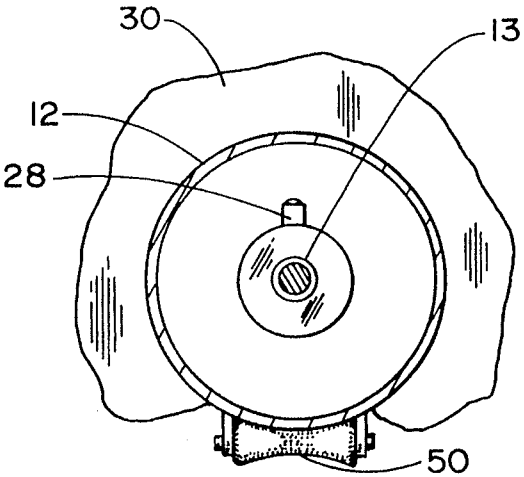
FIG. 10 is a sectional view taken through line 10—10 of FIG. 7.

Referring now to FIGS. 1, 5 and 9, a movable compactor plate 40, also having a diameter about equal to that of the tires, is mountable on end plate 19. Plate 40, like fixed plate 30, has gussets 41, and is adapted to end plate 19 for mounting thereon. Axial post 49, provided on end plate 19, inserts through a relatively small central aperture 46 of compactor plate 40. End plate 19 is also provided with four outstanding bolts 48 that slip through keyholes 44. Once this is accomplished, mounting of plate 40 is perfected by rotating plate 40 about its axis so that the narrow portions of the keyholes engage the bolts 48. Tightening the bolts 48 completes the process. When so mounted compactor plates 30 and 40 oppose one another and can enclose a row of tires 70 to be compacted therebetween. Plate 40 is dismounted by simply loosening bolts 48, rotating the plate in the opposite direction, so that the wide portions of the keyholes 44 are aligned with the bolts, and then displacing plate 40 longitudinally away from end plate 19.

Compactor plates 30 and 40 each have four slots 42 formed therein which extend from the outer edge of the plates inwardly in a radial direction, terminating near support housing 30 and tube 15 respectively. When plate 40 is mounted its slots 42 are in alignment with corresponding slots 33 of plate 30. Four longitudinal wire guides 58 (see FIG. 1) are distributed evenly about the circumference of tube 15 for receiving arrowhead wires 72 when a compacted bundle is bound. The binding procedure is well known from the above-noted U.S. Pat. No. 5,121,680.

Referring now to FIGS. 5–7, 10 and 11, at least two bearings 50, 60, fabricated of a synthetic material such as "Teflon" or the like, facilitate the longitudinal reciprocation of inner tube 15 within support housing 12. Bearing 50 is mounted on the support housing, and has a concave profile that follows the outer curvature of tube 15 (see FIG. 4), while bearing 60, mounted on tube 15, has a convex profile that follows the inner curvature of support housing 12.

Suitable actuation of the hydraulics causes the piston to reciprocate between an extended position, in which nearly the entire length of tube 15 is exteriorized, and a fully retracted position, wherein end plate 19 and fixed compactor plate 30 are in contact.

To use the invention compactor plate 40 is initially dismounted. In one mode of operation piston rod 13 is first fully retracted, and a row of upstanding tires 70, in side-by-side alignment, are positioned adjacent compactor plate 30 so that the tires and compactor plate 30 are coaxial. Suitable racks and conveying equipment (not shown) may advantageously be used to hold the tires in alignment and automate the process. The piston rod 13 is then extended, so that tube 15 slides through the aligned central apertures of the tires, protruding sufficiently through the last tire in the row to allow compactor plate 40 to be mounted as described above. The hydraulics are again actuated to retract the piston rod and compact the row of tires between the compression plates 30, 40. As tube 15 forms a continuous tubular insert within the tires, the latter cannot escape from the row or even be displaced out of alignment during compaction. The inherent safety of this design will be evident to those skilled in the art. The secure alignment of the tires between the two compactor plates that is established by the probe in accordance with the invention results in a precisely aligned compacted product suitable for subsequent applications in which tolerances are small. The compaction stroke can be controlled by a mechanical limit switch (not shown) or by sensing a desired compaction pressure. Appropriate switches and sensors are well known to the art and will not be further discussed herein.

Arrowhead wires of suitable length are inserted through each of the aligned slots 42 around the circumference of the compactor plates and are threaded through the aligned wire guides 58, and looped around the outer surface of the tires. The ends of the arrowhead wires are then hooked together. The hydraulics are then actuated to relax the compacting pressure exerted by the compactor plates so that the bundle of tires expands slightly and tensions the arrowhead wires thereabout.

Figure 4:
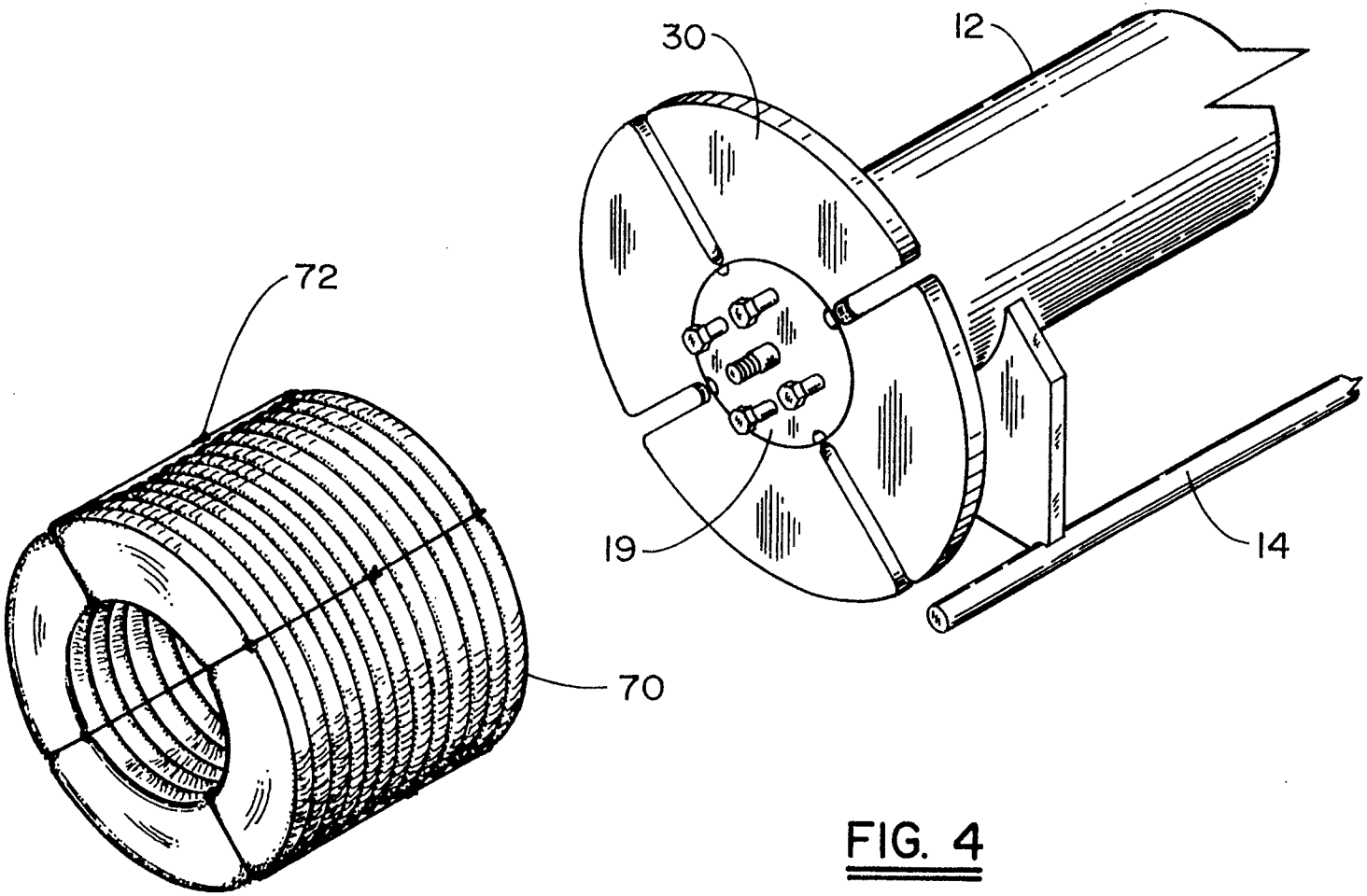
FIG. 4 is another partial perspective view of the embodiment of FIGS. 1–3 with one compression plate dismounted and the piston in full retraction to release a compacted bundle of tires.

Compactor plate 40 is now dismounted, and may be temporarily withdrawn by a mechanical hoist or the like. The hydraulics are once again actuated and piston rod 13 fully retracted to completely retract tube 15 from within the tires, as shown in FIG. 4, the compacted and bound bundle then being removed for recycling or other application.

In another mode of operation the cycle begins by extending the piston rod 13 with the compactor plate 40 dismounted. The tires to be compacted are then shifted onto tube 15 until a sufficient number are assembled to form a row to be compacted. Plate 40 is mounted, and the compaction process proceeds as above. In a further variation of the cycle, it is also possible to extract the compacted bundle from the partially extended tube 15 rather than fully retract the tube 15 from the tires.

While this invention has been explained with reference to the structure disclosed herein, it is not confined to the details set forth and this application is intended to cover any modifications and changes as may come within the scope of the following claims:

What is claimed is:

1. A machine for compacting a row of tires in side-by-side relationship, comprising:

a housing for supporting an elongated hydraulic cylinder/piston combination;

hydraulic means for reciprocating a piston of said cylinder/piston combination between an extended position and a retracted position, said extended comprising a probe that extends through said row of tires, said probe passing through a first compactor plate that is disposed on said housing and contacts a first tire of said row;

a second compactor plate, contacting a last tire of said row and attachable to said probe for movement therewith; and an end plate disposed at an end of said probe, said end plate having an axial post and a plurality of end bolts that align with a central aperture and a plurality of keyholes in said second compactor plate for detachably securing said second compactor plate to said end plate;

whereby said row of tires is compacted between said first compactor plate and said second compactor plate when said probe is retracted by said hydraulic means.

2. The machine in accordance with claim 1, wherein said probe is fully retractable through said first compactor plate to release said compacted row of tires therefrom.

3. The machine in accordance with claim 1, wherein said compactor plates each have a plurality of slots for receiving binding wires therethrough, and said probe further comprises means for guiding said wires therealong, so that a wire can be wrapped about said compacted row of tires.

4. The machine in accordance with claim 1, wherein said first compactor plate and said second compactor plate are each reinforced by at least one gusset.

5. A machine for compacting a row of tires in side-by-side relationship, comprising:

a frame having a platform for receiving thereon a row of tires to be compacted, and further having a support housing attached thereto;

a first compactor plate, dimensioned to contact a first tire of said row, said first compactor plate being mounted in a fixed relation with said frame;

a cylinder/piston combination comprising a piston that reciprocates between an extended position and a retracted position, said cylinder/piston combination being attached to at least one of said support housing and said frame, said piston comprising a retractable probe having an external segment that extends through an opening in said support housing and protrudes through said first compactor plate and through said row of tires, said external segment shortening when said probe is retracted;

a second compactor plate, contacting a last tire of said row and attachable to said probe for longitudinal movement therewith; and a plurality of slots formed in each of said compactor plates for receiving binding wires therethrough, and a plurality of wire guides disposed on said probe;

whereby said row of tires is compacted between said first compactor plate and said second compactor plate when said cylinder/piston combination is moved from said extended position to said retracted position.

6. The machine in accordance with claim 5, wherein said cylinder/piston combination is hydraulically actuated.

7. The machine in accordance with claim 5, wherein said slots open to a peripheral surface of said compactor plates, and are inwardly directed.

8. The machine in accordance with claim 5, wherein said first compactor plate and said second compactor plates are each reinforced by at least one gusset.

9. The machine in accordance with claim 5, further comprising an end plate disposed at an end of said probe, said end plate having an axial post and a plurality of end bolts that align with a central aperture and a plurality of keyholes in said second compactor plate for detachably securing said second compactor plate to said end plate.

* * * * *